United States Patent [19]

Lozen

[11] Patent Number: 4,590,863

[45] Date of Patent: May 27, 1986

[54] SKI LIFT AND LUBRICANT TRAP ASSEMBLY

[76] Inventor: Franklin R. Lozen, 34442 Jefferson Ave., Apt. 20, Mt. Clemens, Mich. 48045

[21] Appl. No.: 567,378

[22] Filed: Dec. 30, 1983

[51] Int. Cl.[4] ..... B61F 19/06; F16N 31/00

[52] U.S. Cl. ..... 104/133; 104/173 ST; 184/106

[58] Field of Search ..... 104/118, 133, 173 R, 104/173 ST; 184/106; 198/495, 678, 685, 686

[56] References Cited

U.S. PATENT DOCUMENTS

| | | | |
|---|---|---|---|
| 240,618 | 4/1881 | Snyder | 104/133 |
| 1,053,760 | 2/1913 | Tyler | 184/106 |
| 1,060,566 | 4/1913 | Harvey | 104/133 |
| 1,129,390 | 2/1915 | Hicks | 184/106 |
| 3,347,172 | 10/1967 | Sowder | 104/173 ST |
| 3,779,171 | 12/1973 | Littlehorn, Jr. | 104/172 ST |
| 4,144,817 | 3/1979 | Morita | 104/133 X |

FOREIGN PATENT DOCUMENTS

| | | | |
|---|---|---|---|
| 2305410 | 8/1973 | Fed. Rep. of Germany | 104/173 ST |

*Primary Examiner*—Robert B. Reeves
*Assistant Examiner*—David F. Hubbuch
*Attorney, Agent, or Firm*—Reising, Ethington, Barnard, Perry & Milton

[57] ABSTRACT

A trap assembly is provided to collect materials dispelled from a ski lift cable suspension assembly. A ski lift post rotatably supports a plurality of wheels through which a longitudinally moveable cable is guided. A collection trough is disposed beneath the wheels and the cable to trap materials dispelled about the wheels.

4 Claims, 3 Drawing Figures

SKI LIFT AND LUBRICANT TRAP ASSEMBLY

TECHNICAL FIELD

This invention relates generally to ski lift assemblies of the type for moving people up a mountain in chairs suspended from a cable supported on wheels suspended from ski lift posts.

BACKGROUND ART

A recurring problem for the owners and operators of any machinery which requires lubrication is that some lubricant eventually drips from the hardware, often damaging items situated below the machinery. This phenomenon is particularly menacing in the ski industry as oil from chair lifts is dispelled onto skiers passing below, persons seated on ski lift chairs, and onto the chairs themselves, damaging expensive and fashionable skiwear.

The prior U.S. Pat. Nos. 1,053,760 to Tyler and 1,129,390 to Hicks disclose hanger boxes and drip pans, respectively, to catch and retain lubricant dispelled from supporting cables. However, there is not available traps or collectors for ski lifts.

STATEMENT OF INVENTION AND ADVANTAGES

The subject invention relates to a ski lift and lubricant trap assembly for collecting lubricant and other materials which are dispelled from a ski lift cable suspension assembly. The assembly comprises a ski lift post assembly which rotatably supports a plurality of wheels. A longitudinally moveable cable engages the wheels while providing for rolling movement therebetween. The assembly is characterized by a collection mechanism which is supported by the post assembly in spaced relationship to the wheels for collecting lubricant and other materials dispelled about the wheels.

FIGURES IN THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
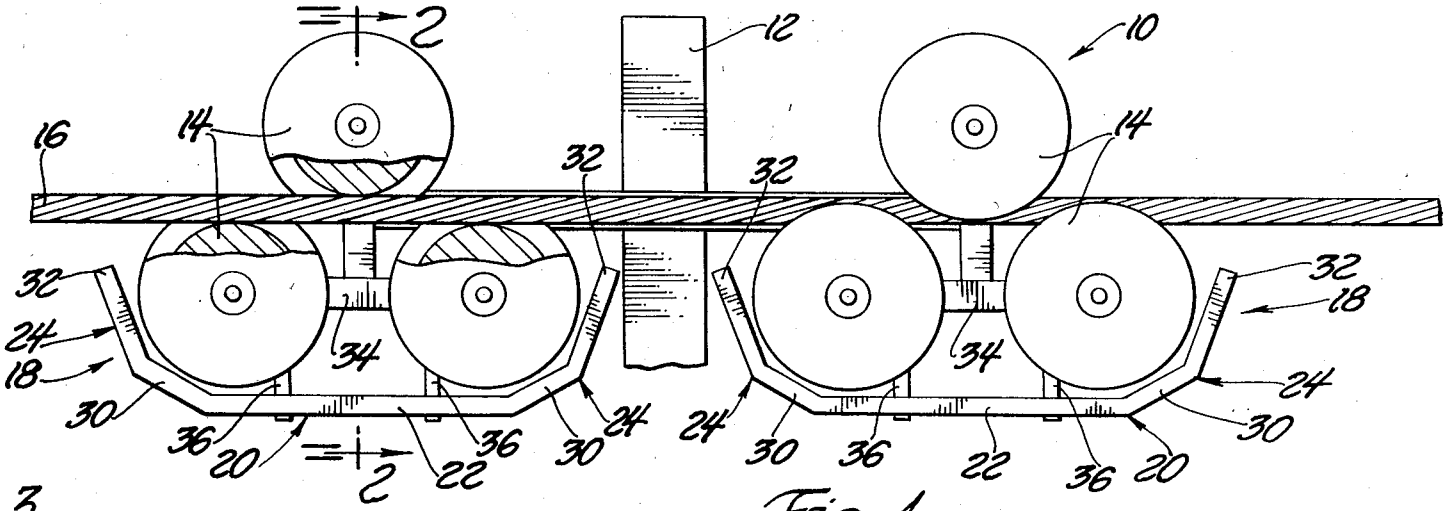
FIG. 1 is a side view partially broken away and in cross section of a ski lift and lubricant trap assembly constructed in accordance with the subject invention.
Figure 3:
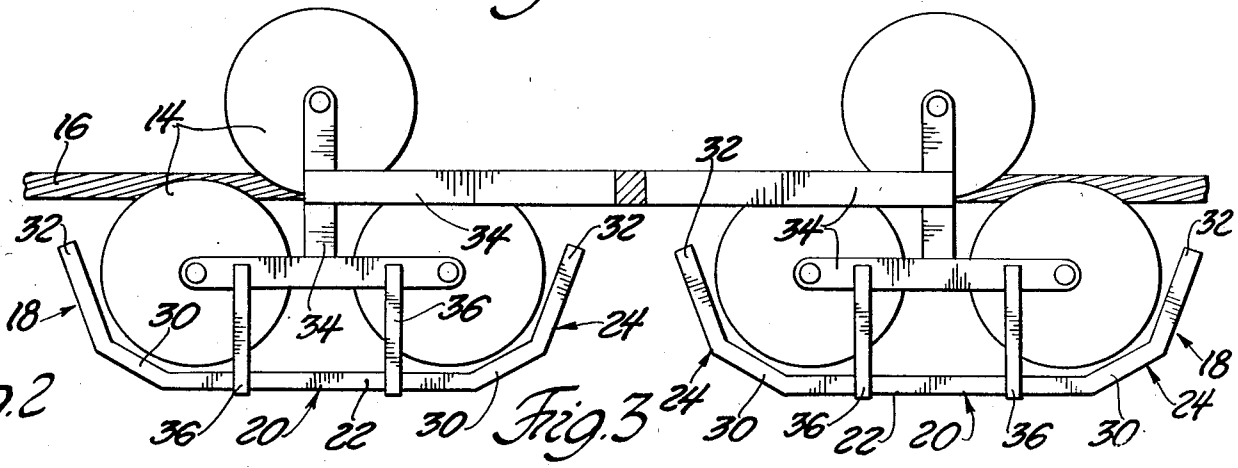
FIG. 3 is a view taken substantially along lines 3—3 of FIG. 2.
Figure 2:
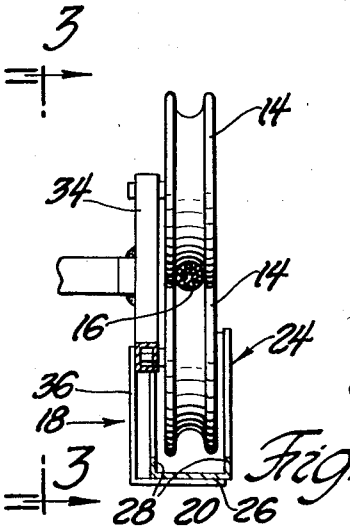
FIG. 2 is a view taken substantially along lines 2—2 of FIG. 1.

The assembly is generally shown at 10 and comprises a ski lift post 12 which supports a plurality of wheels 14 arranged in an array to guide a longitudinally moveable cable 16. The post 12 is of the well known type planted in the ground. The cable 16, which supports a plurality of ski lift chairs, (not shown) is entrained through the wheels 14, the wheels 14 having grooves in the circumference for receiving the cable 16. The assembly is characterized by the collection means 18 supported by the post assembly 12 in spaced relationship to the wheels 14 for collecting lubricant and other materials dispelled about the wheels 14.

The collection means 18 includes a trough 20 disposed below and spaced from the wheels 14. Thus, the trough 20 does not contact the wheels 14 to inhibit the rotational movement of the wheels 14. The trough 20 is suspended below the wheels 14, but close enough that practicles dispelled from the wheels 14 and the ski lift cables 16 do not scatter or fan out in a wider pattern than the width of the trough 20. This minimizes the width and length of the trough 20 since it is suspended close enough to the wheels 14 and cable 16 to catch dispelled particles within a small area.

The wheels 14 are arranged in arrays of three or more with at least one of the wheels 14 being a top wheel located on top of the cable 16 with the other wheels 14 being bottom wheels which engage the bottom of the cable 16. The bottom wheels 14 engage the cable 16 on opposite sides of the contact between the top or middle wheel and the cable 16. The cable 16 is entrained through the wheels 14 by riding in the grooves in the periphery of the wheels.

The trough 20 has a center portion 22 extending below the cable 16 and bottom wheels and further includes a pair of end portions 24 which extend upwardly at least partially about the circumference center portion 22. In other words, the trough 20 has a center portion 22 to catch and retain materials falling directly towards the ground and also end portions 24 to catch and retain materials expelled with lateral trajectories.

The trough further includes bottom 26 and upwardly extending side flanges 28 as viewed in cross section. Thus, dispelled material travelling in the plane of the cable 16 is trapped by the trough and prevented from flowing out of the trough.

The end portions 24 of the trough 20 each include a first straight portion 30 extending upwardly from the adjacent end of the center portion 22 and a second straight portion 32 extending from the first portion 30 at a steeper angle. These end portions 24 extend partially about the circumference of the wheels 14.

The post assembly 12 includes a frame 34 which rotatably supports the wheels 14, while the collection means 18 includes a bracket 36 which interconnects the trough 20 and the frame 34. Thus, the wheels 14 are connected to the ski lift post assembly 12 by the frame 34 and, additionally, trough 20 is connected to the frame 34 by brackets 36. The frame 34 includes a long member or bar parallel to the axis of the ski cable 16 which connects the ski post 12 to an inverted T-shaped frame member 34. This inverted T-shape member 34 is connected at each of its three ends to the trio of wheels 14 at the axes of the wheels 14. The brackets 36 are secured to the trough 20 along the bottom 22 and are attached to one of the flanges 28 of the bottom 22. The brackets 36 extend vertically upwards and attach to the brackets 34.

The collection assembly is supported by the bracket means 36 attached to the trough 20 at one end and the pinions or axes of the wheels 14 at the other end. In other words, the trough 20, together with center portion 22 and end portions 24, define a concave arc which is disposed beneath the wheels 14 and cable 16 by the bracket means 36.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

The embodiments of the invention in which an exclusive property or privilege is claimed are defined as follows:

1. A ski lift and trap assembly combination for collecting lubricant and other materials dispelled from a ski lift cable suspension assembly, said assembly comprising: a longitudinally moveable cable (16), a ski lift post assembly (12), at least three wheels (14) rotatably supported by said post assembly (12) with one of said wheels (14) being a top wheel engaging the top of said cable (16) and the other two wheels (14) being bottom wheels engaging the bottom of said cable (16) on opposite sides of the contact between said cable (16) and said top wheel, said longitudinally moveable cable (16) engaging said wheels (14) for guidance and support by said wheels (14), said wheels (14) being in rolling engagement with said cable (16), characterized by collection means (18) supported by said post assembly (12) in spaced relationship to said wheels (14) for collecting lubricant and other materials dispelled about said wheels (14), said collection means (18) including a trough (20) disposed below and spaced from said wheels (14), said trough (20) having a center portion (22) extending below said bottom wheels and said cable (16) and including end portions (24) extending upwardly from said center portion (22) and at least partially about the circumference of said bottom wheels.

2. An assembly as set forth in claim 1 further characterized by said trough (20) having a bottom (26) and upwardly extending side flanges (28) extending between the ends thereof.

3. An assembly as set forth in claim 2 further characterized by each of said end portions (24) including a first straight portion (30) extending upwardly from the adjacent end of said center portion (22) and a second straight portion (32) extending from said first portion (30) at a steeper angle.

4. An assembly as set forth in claim 3 further characterized by said post assembly (12) including a frame (34) rotatably supporting said wheels (14), and said collection means (18) including a bracket (36) interconnecting said trough (20) and said frame (34).

* * * * *